US010814205B2

(12) United States Patent
Vester

(10) Patent No.: US 10,814,205 B2
(45) Date of Patent: Oct. 27, 2020

(54) RECONFIGURABLE FITNESS EQUIPMENT STORAGE APPARATUS

(71) Applicant: James Edward Vester, Frisco, TX (US)

(72) Inventor: James Edward Vester, Frisco, TX (US)

( * ) Notice: Subject to any disclaimer, the term of this patent is extended or adjusted under 35 U.S.C. 154(b) by 119 days.

(21) Appl. No.: 15/946,852

(22) Filed: Apr. 6, 2018

(65) Prior Publication Data

US 2018/0290042 A1 Oct. 11, 2018

(30) Foreign Application Priority Data

Apr. 6, 2017 (GB) ..... 1705589.8

(51) Int. Cl.

| | |
|---|---|
| ***A63B 71/00*** | (2006.01) |
| ***A47F 5/10*** | (2006.01) |
| ***A63B 71/02*** | (2006.01) |
| ***A63B 21/072*** | (2006.01) |

(52) U.S. Cl.

CPC ..... *A63B 71/0036* (2013.01); *A47F 5/101* (2013.01); *A63B 71/023* (2013.01); *A63B 21/072* (2013.01); *A63B 21/0726* (2013.01); *A63B 2071/024* (2013.01); *A63B 2225/09* (2013.01); *A63B 2225/093* (2013.01)

(58) Field of Classification Search

CPC ..... A63B 71/0036; A63B 71/023; A63B 2225/093; A63B 21/072; A63B 2071/024; A63B 2225/09; A63B 21/0726; A47F 5/101; A47B 47/022; A47B 47/024; A47B 47/028; A47B 57/46; A47B 57/52

See application file for complete search history.

(56) References Cited

U.S. PATENT DOCUMENTS 1,342,236 A * 6/1920 Szako ..... B23D 63/003 76/78.1
1,673,205 A * 6/1928 Romao ..... G10G 5/00 211/85.6
1,896,604 A * 2/1933 Bales ..... A47F 5/108 108/100
1,964,124 A * 6/1934 Keller ..... A47F 5/10 108/96
1,976,345 A * 10/1934 Hruby ..... E06C 1/20 182/171

(Continued)

*Primary Examiner* — Garrett K Atkinson
(74) *Attorney, Agent, or Firm* — Allen Dyer et al.

(57) ABSTRACT

A reconfigurable fitness equipment storage apparatus is provided which is both freestanding and wall-mountable. The apparatus comprises two spaced apart parallel elongate uprights, a wall-engagable element to retain each upright in a position relative to an associated wall, a ground support member associated with each upright, and at least one shelving element which is selectably mountable between the uprights in a wall-mounted condition and a freestanding condition. In the wall-mounted condition, the or each shelving element is cantilevered from the uprights to be fixable to the wall via the wall-engagable elements. In the freestanding condition, the or each shelving element is positioned such that a centre of gravity of the or each shelving element is coincident or substantially coincident with a plane extending between uprights to enable the storage apparatus to be self-supported on the said ground support members.

20 Claims, 7 Drawing Sheets

(56) References Cited

U.S. PATENT DOCUMENTS 3,794,183 A * 2/1974 Colbridge ..... A47B 46/00 211/208
4,056,196 A * 11/1977 Brauning ..... A47B 57/54 211/207
4,070,072 A * 1/1978 Skaller ..... B65G 1/07 108/136
4,116,509 A * 9/1978 Smith ..... A47B 47/00 108/108
D262,076 S * 12/1981 Pracon ..... D6/407
4,746,021 A * 5/1988 Helmholdt ..... A47B 47/00 108/149
4,770,380 A * 9/1988 Eason ..... F16M 11/28 248/165
4,898,286 A * 2/1990 Orlandi ..... A47B 57/52 211/187
4,919,282 A * 4/1990 Duff ..... A47B 57/26 211/134
5,273,248 A * 12/1993 Grander ..... A47B 85/00 211/2
5,482,168 A * 1/1996 Welch ..... A47B 96/00 211/106
5,531,168 A * 7/1996 Towfigh ..... A47B 17/02 108/108
5,918,432 A * 7/1999 Mahone ..... A47B 47/00 52/220.2
6,138,583 A * 10/2000 Mahone ..... A47B 47/00 108/108
6,422,399 B1 * 7/2002 Castillo ..... A47B 57/40 211/175
6,974,039 B2 * 12/2005 Comartin ..... A63B 71/0036 211/41.1
7,434,661 B1 * 10/2008 Storey ..... E06C 1/36 182/100
7,866,491 B2 * 1/2011 Newman ..... A47B 43/00 211/87.01
7,878,340 B1 * 2/2011 Olsen ..... A47B 73/00 211/186
8,281,943 B2 * 10/2012 Suman ..... A47F 5/0087 211/150
9,737,783 B2 * 8/2017 Doerr ..... A63B 71/0036
10,039,379 B1 * 8/2018 Phillips ..... A47F 5/08
10,433,640 B2 * 10/2019 Sanchez Anton .... A47B 47/028
2003/0168951 A1 * 9/2003 Holbrook ..... A47B 57/565 312/245
2003/0189021 A1 * 10/2003 Engel ..... A47B 57/06 211/187
2004/0140277 A1 * 7/2004 Comartin ..... A63B 71/0036 211/59.1
2005/0054494 A1 * 3/2005 Guerrettaz ..... A63B 71/0036 482/97
2008/0023355 A1 * 1/2008 Reynolds ..... A63B 71/0036 206/315.1
2008/0053928 A1 * 3/2008 Klauer ..... A47B 47/021 211/49.1
2012/0085721 A1 * 4/2012 Drobot ..... A47B 57/562 211/103
2012/0267329 A1 * 10/2012 Herman Baran ..... A47F 1/06 211/59.2
2014/0091696 A1 * 4/2014 Welker ..... A47F 5/0043 312/408
2014/0353271 A1 * 12/2014 Kruse ..... A47F 5/01 211/188
2015/0258412 A1 * 9/2015 Doerr ..... A63B 71/0036 482/93
2016/0263459 A1 * 9/2016 Hillson ..... A63B 71/0036
2018/0126244 A1 * 5/2018 Doerr ..... A63B 71/0036
2018/0228282 A1 * 8/2018 Phillips ..... A47B 43/00
2018/0353834 A1 * 12/2018 Green ..... A63B 71/0036
2019/0038020 A1 * 2/2019 Sanchez Anton .. A47B 47/0091

* cited by examiner

Figure 9a
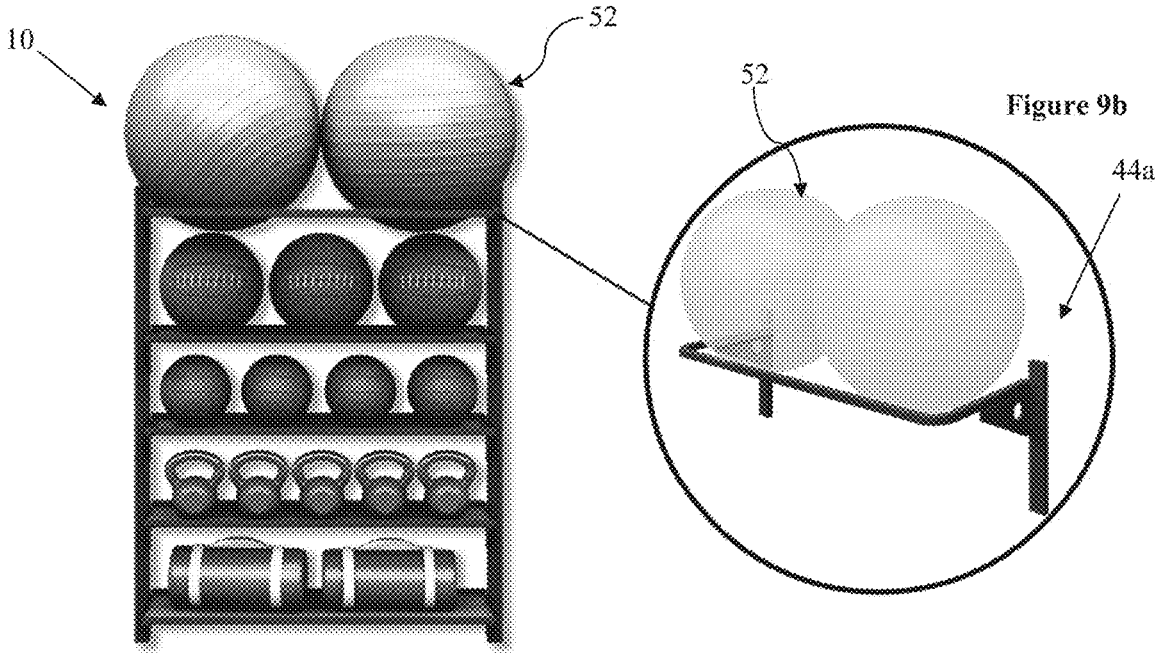
Figure 9b
Figure 10a
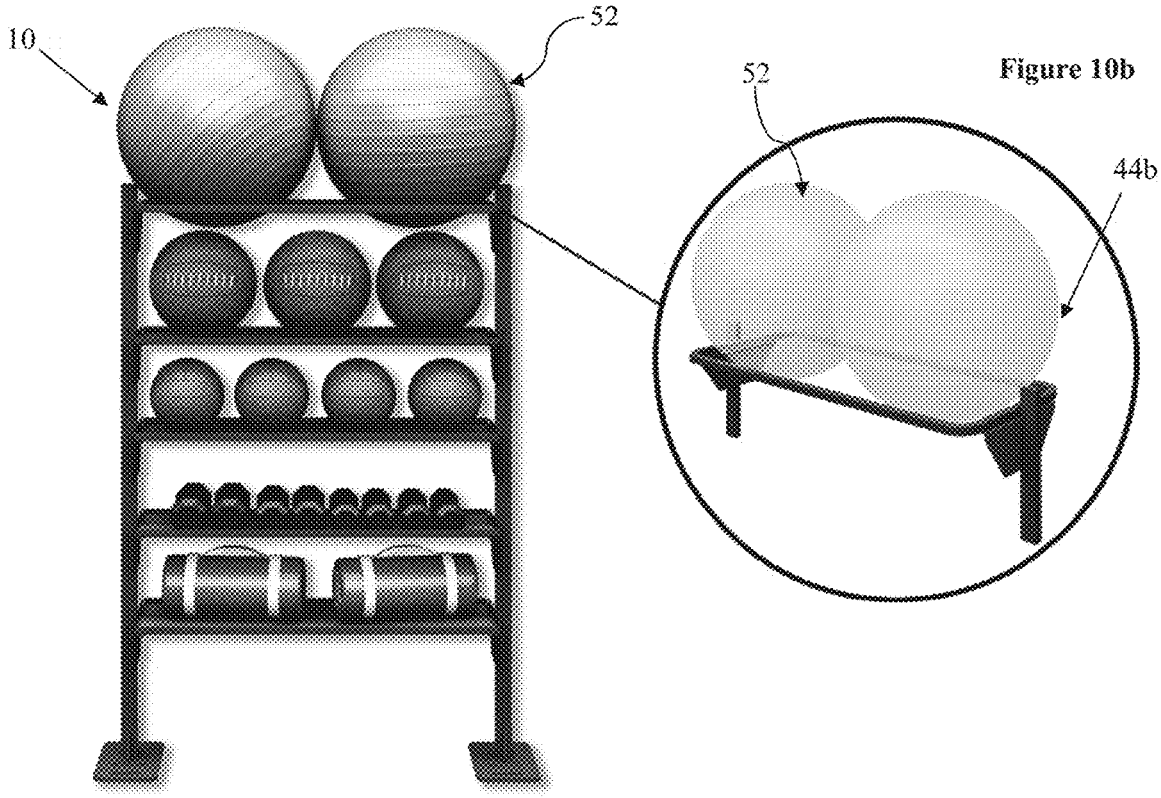
Figure 10b

RECONFIGURABLE FITNESS EQUIPMENT STORAGE APPARATUS

RELATED APPLICATIONS

This application claims the benefit under 35 U.S.C. § 119(a)-(d) of British Patent Application No. 1705589.8 filed on 6 Apr. 2017, the disclosure of which is incorporated by reference.

FIELD

The present invention relates to a reconfigurable storage apparatus, particularly but not necessarily exclusively for the storage of fitness equipment in, for example, a gymnasium or exercise room. Methods of converting a wall-mounted fitness equipment storage apparatus to a freestanding fitness equipment storage apparatus and vice versa are also provided.

BACKGROUND

Fitness equipment is equipment used in physically active contexts specifically for the improvement of a user's fitness. Weights or weighted equipment, such as dumbbells or kettle bells are commonly used, as is lightweight equipment such as exercise mats and medicine balls.

Storage of the fitness equipment can be challenging. Heavy equipment can cause damage to shelving if the shelving is overloaded or inadequately reinforced to receive the load applied, whereas lightweight equipment is prone to rolling or falling from planar shelving. Medicine balls in particular are difficult to store, with one solution being to partially deflate the balls to ensure that they do not roll from their storage area. Reinflation is a relatively slow process.

As such, the most convenient solution to storage of all types of fitness equipment is to purchase bespoke storage configurations which are customized to the user's storage requirements. However, such bespoke arrangements are immutable once installed, as the joints are welded together in order to provide the required strength of the shelving, and therefore cannot be repositioned easily within the gymnasium. This can be a problem where alternative layouts are required in order to perform particular exercise routines in the area.

A further problem associated with any storage apparatus is delivery to an installation site. Where a bespoke product is manufactured, the unit then has to be transported to the building in which it will be installed. If the installation space is not at ground level, further complications arise. Transport and installation can all amount to significantly more cost than the apparatus itself in view of weight and physical size.

SUMMARY

The present invention seeks to provide a storage solution which can be customised to a user's installation needs, whilst also minimising the bulk of packaging of the storage equipment for shipping.

According to a first aspect of the invention, there is provided a reconfigurable fitness equipment storage apparatus which is both freestanding and wall-mountable, the reconfigurable fitness equipment storage apparatus comprising: two spaced apart parallel elongate uprights; a wall-engagable element to retain each upright in a position relative to an associated wall; a ground support member associated with each upright; and at least one shelving element which is selectably mountable between the uprights in a wall-mounted condition and a freestanding condition; in the wall-mounted condition, the or each shelving element being cantilevered from the uprights to be fixable to the wall via the wall-engagable elements; and in the freestanding condition, the or each shelving element being positioned such that a centre of gravity of the or each shelving element is coincident or substantially coincident with a plane extending between the uprights to enable the storage apparatus to be self-supported on the said ground support members.

The provision of selectably mountable and demountable shelving allows for a single apparatus to be provided that can readily fulfil a user's storage requirements in different contexts. Since the apparatus can be both wall-mounted and stably allowed to freestanding, the user is not required to decide whether a single bespoke wall-mounted or freestanding storage arrangement should be provided. Instead, they are able to assemble the fitness equipment storage apparatus in lie with their own requirements, and can remount or move the apparatus if necessary in order to improve the layout of their exercise space for specific tasks.

Preferable and/or optional features of the first aspect of the invention are set forth in claims 2 to 24, inclusive.

According to a second aspect of the invention, there is provided a method of converting a wall-mounted fitness equipment storage apparatus to a freestanding fitness equipment storage apparatus, the method comprising the steps of: a] providing a reconfigurable fitness equipment storage apparatus, preferably in accordance with the first aspect of the invention, in a wall-mounted condition; b] disengaging the wall-engagable elements from a wall to which the uprights are mounted; c] converting the or each shelving element from its cantilevered state of the wall-mounted condition to its balanced state of the freestanding condition such that a centre of gravity of the or each shelving element is coincident with a plane extending between the uprights; and d] standing the reconfigurable fitness equipment storage apparatus on its ground support members so as to be freestanding.

According to a third aspect of the invention, there is provided a method of converting a freestanding fitness equipment storage apparatus to a wall-mounted fitness equipment storage apparatus, the method comprising the steps of: a] providing a reconfigurable fitness equipment storage apparatus, preferably in accordance with the first aspect of the invention, in a freestanding condition; b] converting the or each shelving element from its balanced state of the freestanding condition such that a centre of gravity of the or each shelving element is coincident with a plane extending between the uprights to its cantilevered state of the wall-mounted condition; and c] engaging the wall-engagable elements with a wall to mount the uprights thereto.

Preferably, the method may comprise a step prior to step c] of disengaging the ground support members from the uprights.

BRIEF DESCRIPTION OF THE DRAWINGS

The invention will now be more particularly described, by way of example only, with reference to the accompanying drawings, in which:

FIG. 9*a* shows a front representation of the reconfigurable fitness equipment storage apparatus of FIG. 6 in a second wall-mounted condition;

FIG. 9*b* shows a perspective representation of the bridging unit of the reconfigurable fitness equipment storage apparatus of FIG. 9*a;*

FIG. 10*a* shows a front representation of the reconfigurable fitness equipment storage apparatus of FIG. 6 in a third freestanding condition; and FIG. 10*b* shows a perspective representation of the bridging unit of the reconfigurable fitness equipment storage apparatus of FIG. 10*a*.

DETAILED DESCRIPTION

Figure 1:
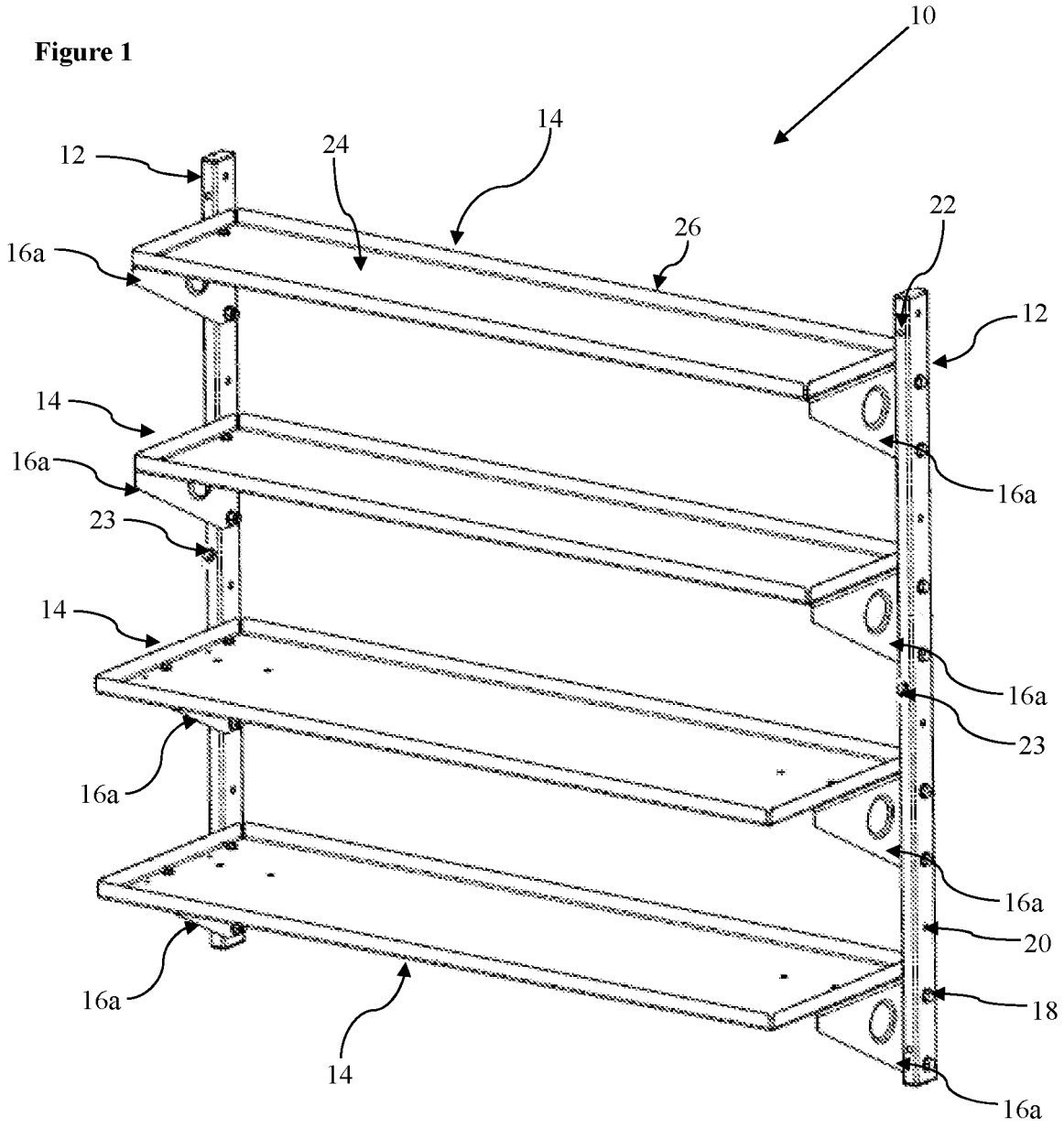
FIG. 1 shows an isometric view of one embodiment of a reconfigurable fitness equipment storage apparatus in accordance with the first aspect of the invention, the reconfigurable fitness equipment storage apparatus being in a wall-mounted condition.
Figure 2:
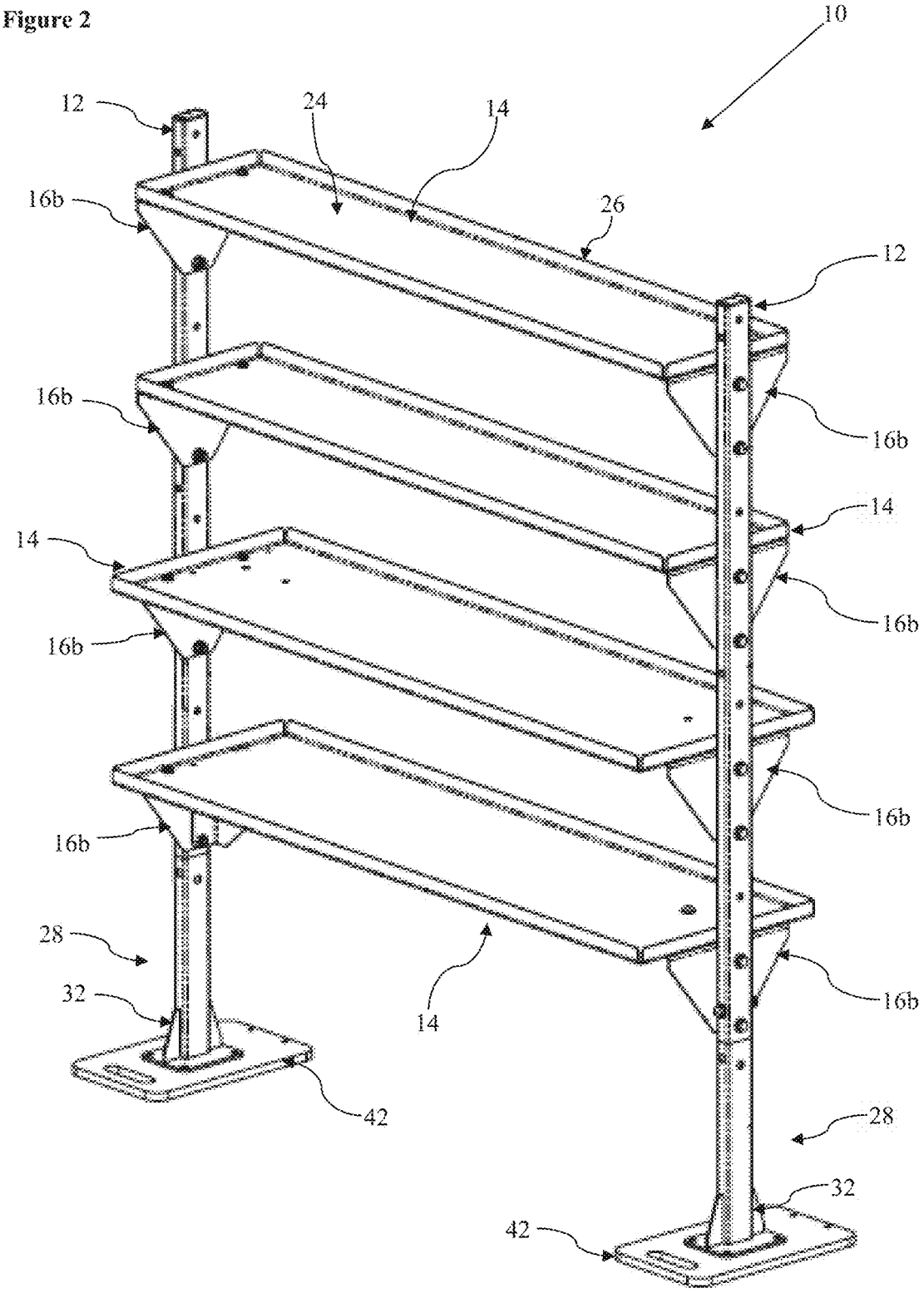
FIG. 2 shows an isometric view of the reconfigurable fitness equipment storage apparatus of FIG. 1 in a freestanding condition.

Referring to FIG. 1, there is shown a reconfigurable fitness equipment storage apparatus, indicated globally at 10, which is suitable for storing fitness equipment and which can be reconfigured between a wall-mounted condition, as can be seen in FIG. 1, and a freestanding condition, which is illustrated in FIG. 2.

The terms wall-mounted and/or wall-mountable, and freestanding are used in the present context to respectively refer to an apparatus which is directly or indirectly mounted to a wall such that there is no weight from the apparatus transferred to the floor of an area in which the apparatus is installed, and to an apparatus which is self-supporting on a floor. The term freestanding does not exclude the option of attaching the apparatus to a wall or other support structure, but that the apparatus is capable of self-support.

Fitness equipment is here intended to refer to any equipment which would ordinarily be utilised in a gymnasium or exercise room, and can include, but is not limited to: medicine balls, also known as Swiss balls; dumbbells; lifting weights; kettle bells; sports balls such as basketballs, soccer balls, footballs; exercise mats; ropes; and similar exercise equipment.

The reconfigurable fitness equipment storage apparatus 10 comprises two uprights 12 which are parallel and spaced apart from one another, and are vertical or substantially vertical in an assembled condition of the reconfigurable fitness equipment storage apparatus 10 in both the wall-mounted and freestanding conditions.

In the assembled condition, the two uprights 12 define a plane therebetween. It will be appreciated that when a centre of gravity of the reconfigurable fitness equipment storage apparatus 10 is coincident or substantially coincident with this plane, then it is possible for the reconfigurable fitness equipment storage apparatus 10 to be self-supporting. However, in the wall-mounted condition, the uprights 12 will be at or adjacent to the wall to which the reconfigurable fitness equipment storage apparatus 10 is to be mounted, and therefore the centre of gravity of the reconfigurable fitness equipment storage apparatus 10 will be displaced from the plane.

The reconfigurable fitness equipment storage apparatus 10 further includes at least one, and preferably a plurality of, shelving elements 14 which are engagable with the uprights 12 to form shelves or supports for fitness equipment. Four such shelving elements 14 are illustrated in FIG. 1, and these shelving elements 14 may be differently sized so as to accommodate fitness equipment of different sizes.

The shelving elements 14 may be directly mountable to the uprights 12 in order to secure them in position. However, given the weight of typical fitness equipment, it will be appreciated that a preferred engagement arrangement will include one or more brackets 16*a*, 16*b* which are able to support the shelving elements 14 to provide a more even distribution of weight for the reconfigurable fitness equipment storage apparatus 10.

FIG. 1 shows the wall-mounted condition of the reconfigurable fitness equipment storage apparatus 10. Each shelving element 14 is provided with a pair of brackets 16*a* which are engagable with respective uprights 12 in a cantilevered manner, that is, the brackets 16*a* projects from the uprights 12 in only one direction in an assembled condition.

Preferably, the reconfigurable fitness equipment storage apparatus 10 is formed as a modular kit of parts, allowing the user to assemble the reconfigurable fitness equipment storage apparatus 10 to their satisfaction. In the depicted embodiment, this is achieved by provided releasable fasteners which connect the uprights 12 and brackets 16*a* and the brackets 16*a* and shelving elements 14. These may be provided as screw-threaded fasteners, such as bolts 18 for ease of construction. Alternatively, the brackets 16*a* and shelving elements 14 could be integrally formed with one another.

The uprights 12 are here formed having a plurality of connection apertures 20 along their lengths, allowing the brackets 16*a* to be fastened thereto at various different positions along the length of each upright 12.

The cantilevered brackets 16*a* may be provided as triangular or substantially triangular brackets, which are sized such that a projecting distance of the bracket 16*a* is greater than or equal to at least half of the depth of each shelving element 14. Different sizes of brackets 16*a* may be provided for shelving elements 14 of different depths, or, as illustrated, each shelving element 14 may have an associated identical pair of brackets 16*a*. For shallow shelving elements 14, this may allow the brackets 16*a* to extend along the full extent of the depth of the shelving element 14, whereas for larger shelving elements 14, the projection of each bracket 16*a* may be closer to half the depth of the shelving element 14, as can be seen for the lower two shelving elements 14 in FIG. 1.

The reconfigurable fitness equipment storage apparatus 10 shown in FIG. 1 includes a wall-engagable element to retain each upright 12 in a position relative to an associated wall. The wall-engagable element is here illustrated by the fixing apertures 22 in the uprights 12, which are positioned so as to run through each upright 12 in a direction perpendicular to the bore of each connection aperture 20. It will be appreciated that the wall-engagable element will require a fixing connector 23 in order to effect engagement of the reconfigurable fitness equipment storage apparatus 10 with a wall. This could be provided as a screw threaded connector, strong fabric bindings, mounting port, or a wall-mounting bracket plate. Effective fixing connectors 23 will be evident to the skilled person, based on the weight of the fitness equipment to be stored; heavier equipment will require a more robust fixing connector 23.

Each shelving element 14 is provided here as a planar shelf 24 having an upstanding lip or rim 26 which extends around at least part of a perimeter of the planar shelf 24. This may assist with retaining fitness equipment on the shelving element 14, particularly where rounded fitness equipment is to be stored, such as balls.

There may be provided a reinforcing member or reinforcing member receiving element associated with the or each shelving element 14 which allows the shelving element 14 to be supplementarily rigidified or strengthened. This may be of particular importance for supporting weighted fitness equipment, such as kettle bells. Whilst not visible in the depicted embodiment, the shelving elements 14 may be provided with a corrugated channel affixed to one face of the planar shelf 24 which allows the insertion of a strengthening element, such as a strengthening bar, which can span the distance between the uprights 12. Such a strengthening bar could be directly engagable with the brackets 16*a* and/or the uprights 12 for additional support.

Preferably, any or all of the reconfigurable fitness equipment storage apparatus 10 is formed from a rigid and durable material which is capable of supporting heavy equipment, such as steel. It will be appreciated that non-load-bearing components of the reconfigurable fitness equipment storage apparatus 10 need not necessarily be formed from such material. For example, the rim 26 of the shelving elements 14 could be formed from a softer material, such as plastics material, rubber or an elastomer, which may limit damage to the fitness equipment when being placed on or removed from the reconfigurable fitness equipment storage apparatus 10 in use.

The reconfigurable fitness equipment storage apparatus 10 is reconfigurable between a wall-mounted condition and a freestanding condition. The freestanding condition is shown in FIG. 2.

Figure 3:
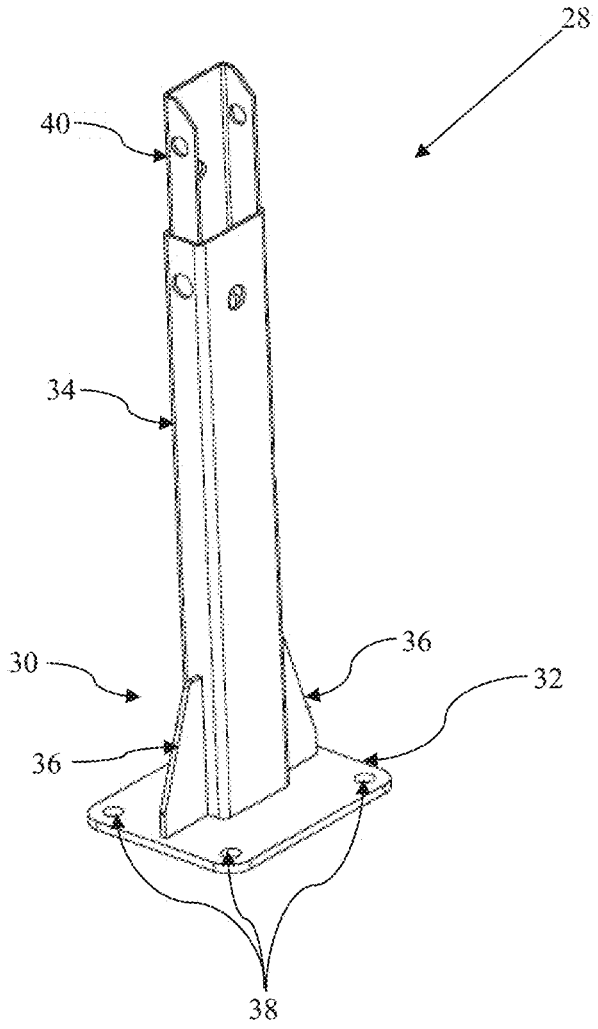
FIG. 3 shows an isometric view of one ground support member of the reconfigurable fitness equipment storage apparatus shown in FIG. 2.

In the freestanding condition, the reconfigurable fitness equipment storage apparatus 10 further comprises a ground support member 28 associated with each upright 12 upon which the reconfigurable fitness equipment storage apparatus 10 is positionable so as to be self-supporting. The ground support member 28 can be seen in more detail in FIG. 3.

Each ground support member 28 in the present embodiment comprises a foot portion 30, which is here formed as a ground plate 32 having a stem portion 34 extending vertically therefrom and which is engagable with one or other upright 12. One or more buttresses 36 may be provided so as to provide structural rigidity between the ground plate 32 and the stem portion 34. The ground plate 32 may be provided having one or more apertures 38 therein, thereby permitting the ground support member 28 to be secured to a floor.

Preferably, the ground support member 28 is releasably engagable with its corresponding upright 12, and in the present embodiment, interconnection of the ground support member 28 and upright 12 is effected by the provision of a telescopic member 40 which may be receivable within or around one or both of the upright 12 and stem portion 34 of the ground support member 28. The telescopic member 40 may be lockable in place using screw-threaded fasteners, or could be provided with a detent-style latch, for example. Vertical adjustment of the apparatus 10 using telescopic members 40 may firstly allow for a greater spacing between adjacent shelving elements 14, which may in turn permit taller items to be stacked on the shelves, and also may allow for the ready connection of the apparatus with a ceiling, for additional stabilisation, if required.

By permitting releasable engagement between the ground support members 28 and the respective uprights 12, it may be more straightforward for the apparatus 10 to be made to be flush with a wall in the wall-mounted condition, simplifying the ease of mounting of the apparatus 10. Similarly, it may allow the ground support elements to be permanently or semi-permanently engaged in position with the floor, thereby permitting quick reconfiguration of the apparatus 10 without needing to ensure stability in the freestanding condition beforehand.

Alternatively, the ground support members 28 may be fixed in position permanently on a floor, if desired, with the uprights 12 only being engaged upon removal of the reconfigurable fitness equipment storage apparatus 10 from the wall-mounted condition. Additionally, or alternatively, one or more stabilisation plates 42 may be provided with which the foot portion 30 is engagable, and which can act to provide a more stable basal area for the reconfigurable fitness equipment storage apparatus 10 in the freestanding condition.

Preferably, each ground support element 28 may comprise a said foot portion 30. The ground support element 28 may comprise the stabilisation plate 42 which is engagable with the foot portion 30, and preferably, said stabilisation plate 42 may be releasably engagable with the foot portion 30.

Depending on the equipment to be stored, the engagement of the apparatus 10 with the floor in the freestanding condition may be increased or decreased. Some configurations may benefit from the increased portability provided by sturdy stabilization plates 42, whereas more heavy-duty storage apparatus 10 may benefit from permanent or semi-permanent fixation to the floor.

In the freestanding condition, the shelving elements 14 are positioned such that a centre of gravity of the or each shelving element 14 is coincident or substantially coincident with the plane extending between the uprights 12 to enable the reconfigurable fitness equipment storage apparatus 10 to be self-supported on the ground support members 28.

The shelving elements 14 illustrated in FIG. 2 are the same shelving elements 14 as those in the wall-mounted condition illustrated in FIG. 1. This is the preferred arrangement, as fewer components are required in order to reconfigure the reconfigurable fitness equipment storage apparatus 10; however, it will be appreciated that different shelving elements 14 could be provided in each of the wall-mountable and freestanding conditions.

Therefore, in one embodiment of the invention, the or each shelving element 14 may comprise a single shelving member which is selectively engagable with the at least one pair of brackets 16*a*, 16*b* in the wall-mounted and freestanding conditions. Alternatively, the or each shelving element 14 may comprise a first shelving member which is cantilevered from the uprights 12 in a first direction in the wall-mounted condition, and a second shelving member 14 which at least in part projects away from the uprights 12 in a second direction which is opposite to the first said direction in the freestanding condition, in which case, the first and second shelving members may be mutually engagable in the freestanding condition.

There are various advantages to the different embodiments of the shelving elements. A single shelving member which can be selectably repositioned between the wall-mounted and freestanding conditions limits the number of components required in order to reconfigure the apparatus, potentially reducing the manufacturing complexity of the apparatus. On the other hand, having interconnectable shelving members may advantageously simplify the reconfiguration process, as components need only be added in the freestanding condition, rather than requiring full disassembly of the apparatus upon reconfiguration.

Each shelving element 14 may be provided with a pair of brackets 16*b* in the freestanding condition which is different to the pair of brackets 16*a* for the cantilevered wall-mounted condition. It may, of course, be possible to provide brackets which are usable in both conditions, however, for example, by providing modifiable brackets which could be opened out in the freestanding condition to provide support for the shelving element 14 in a direction opposite to the direction of cantilevering in the wall-mounted condition.

The brackets 16*b* preferably have a centre of gravity which is coincident or substantially coincident with the plane extending between the uprights 12 once installed, with the corresponding shelving element 14 being mountable centrally on the brackets 16*b* so as to span between the uprights 12. The brackets 16*b* may, as can be seen in FIG. 2, be formed as or substantially as symmetric trapezia, therefore projecting equally in both directions from the uprights 12 once installed.

To summarise, at least one pair of brackets 16*a*, 16*b* may be provided associated with the or each shelving element 14 for mounting to the uprights 12. The first said pair of brackets 16*a* may be provided for the wall-mounted condition, the first pair of brackets 16*a* being cantilevered from the uprights 12 in use, and a different second said pair of brackets 16*b* is provided for the freestanding condition, the second pair of brackets 16*b* having a centre of gravity which is coincident or substantially coincident with the plane extending between the uprights 12. Selectably mountable brackets 16*a*, 16*b* allow for the shelving elements 14 to be mounted to the uprights 12 without compromising the stability of the apparatus 10 in either configuration.

Optionally, a releasable connector may be provided which releasably secures a relative position of the or each shelving element 14 to the at least one pair of brackets 16*a*, 16*b*.

A releasable connector beneficially simplifies the mechanism of connection between any given shelving element 14 and its respective brackets 16*a*, 16*b*, improving the ease with which a user may reconfigure the whole apparatus.

To convert the wall-mounted fitness equipment storage apparatus 10, as shown in FIG. 1, to a freestanding fitness equipment storage apparatus 10, as shown in FIG. 2, the user must disengage the wall-engagable elements from a wall to which the uprights 12 are mounted, and then convert the or each shelving element 14 from its cantilevered state of the wall-mounted condition to its balanced state of the freestanding condition such that a centre of gravity of the or each shelving element is coincident with a plane extending between the uprights 12. The reconfigurable fitness equipment storage apparatus 12 can then be stood on its ground support members 28 so as to be freestanding.

To convert a freestanding fitness equipment storage apparatus 10 to a wall-mounted fitness equipment storage apparatus 10, the user must convert the or each shelving element 14 from its balanced state of the freestanding condition such that a centre of gravity of the or each shelving element is coincident with a plane extending between the uprights to its cantilevered state of the wall-mounted condition. Once this is done, the wall-engagable elements can be affixed to a wall to mount the uprights 12 thereto. Usually, the user will have disengaged the ground support members 28 from the uprights 12 first, although it will be appreciated that correctly shaped ground support members 28 could be provided which can remain affixed to the reconfigurable fitness equipment storage apparatus 10 even when mounted to the wall.

Figure 4:
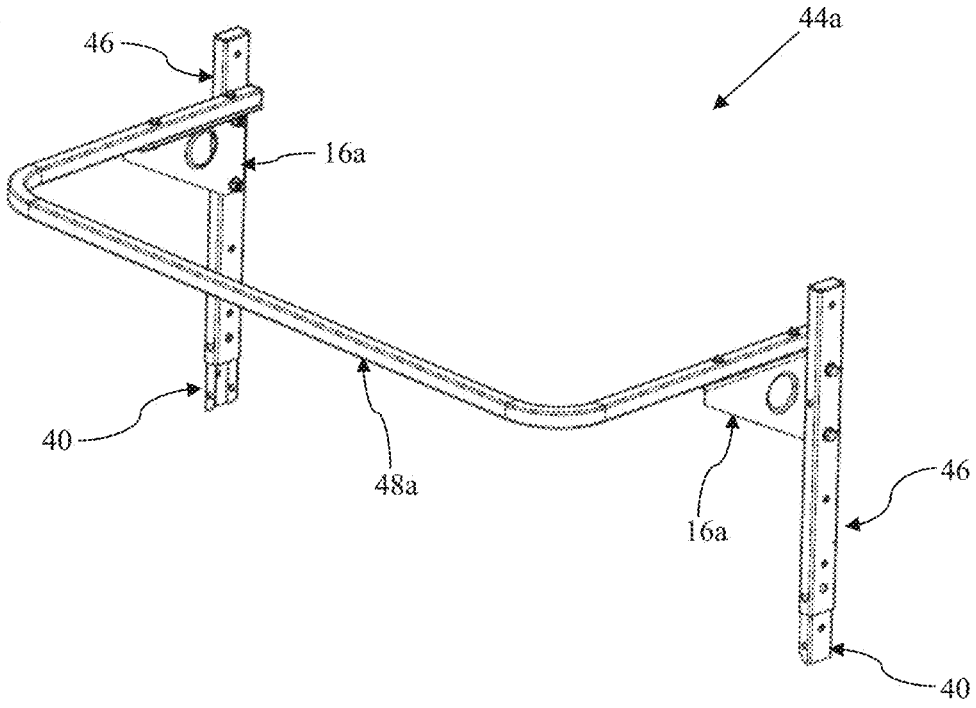
FIG. 4 shows an isometric view of a first embodiment of a bridging unit for the reconfigurable fitness equipment storage apparatus shown in FIG. 1, the bridging unit being suitable for use in the wall-mounted condition.

FIG. 4 shows an optional bridging unit 44*a* which may be engaged with the reconfigurable fitness equipment storage apparatus 10 to provide further storage for fitness equipment in the wall-mounted condition. The bridging unit 44*a* can provide additional storage space for the apparatus 10, and may advantageously also have different configurations which allow it to be used in both the wall-mounted and freestanding conditions, as can be seen in the arrangement shown in FIG. 5, indicated by reference 44*b*. The bridging units 44*a*, 44*b* may also advantageously improve the rigidity of the apparatus 10 once installed, limiting the propensity for the uprights to skew relative to one another, and may also provide a means of extending the amount of storage available to the user of the apparatus 10.

The bridging unit 44*a* comprises a pair of upright struts 36 which may be engagable with a top or top portion of the uprights 12. Between the pair of upright struts 36 is provided a further shelving element 14, which here comprises a C- or U-shaped support bar 48*a*. The support bar 48*a* is engagable with the upright struts 48*a* via a pair of cantilever brackets 16*a*, such that the support bar 48*a* is cantilevered from the upright struts 36.

The support bar 48*a* is devoid of a planar shelf, and therefore defines a bounded region with the wall, once the reconfigurable fitness equipment storage apparatus 10 is mounted in the wall-mounted condition, within which a medicine ball is receivable. A portion of the medicine ball in use projects below the support bar 48*a*, thereby inhibiting unintentional escape of the medicine ball from the reconfigurable fitness equipment storage apparatus 10.

In view of the above, it will be apparent that shelving elements 14 may advantageously be provided so as to have specific functions, thereby allowing a user to select which shelves are most suitable for their storage needs. This solves the problem of existing arrangements typically being suitable only for either lightweight fitness equipment or heavy fitness equipment. The present invention is able to circumvent this restriction with the provision of different shelf types.

As with the ground support members 28, the bridging unit 44*a* may include a telescopic member 40 which is receivable within or around an upright 12 and its corresponding upright strut 36 to permit telescopic engagement therebetween. These telescopic members 40 may also be lockable in place using screw-threaded fasteners, or could be provided with a detent-style latch, for example.

Figure 5:
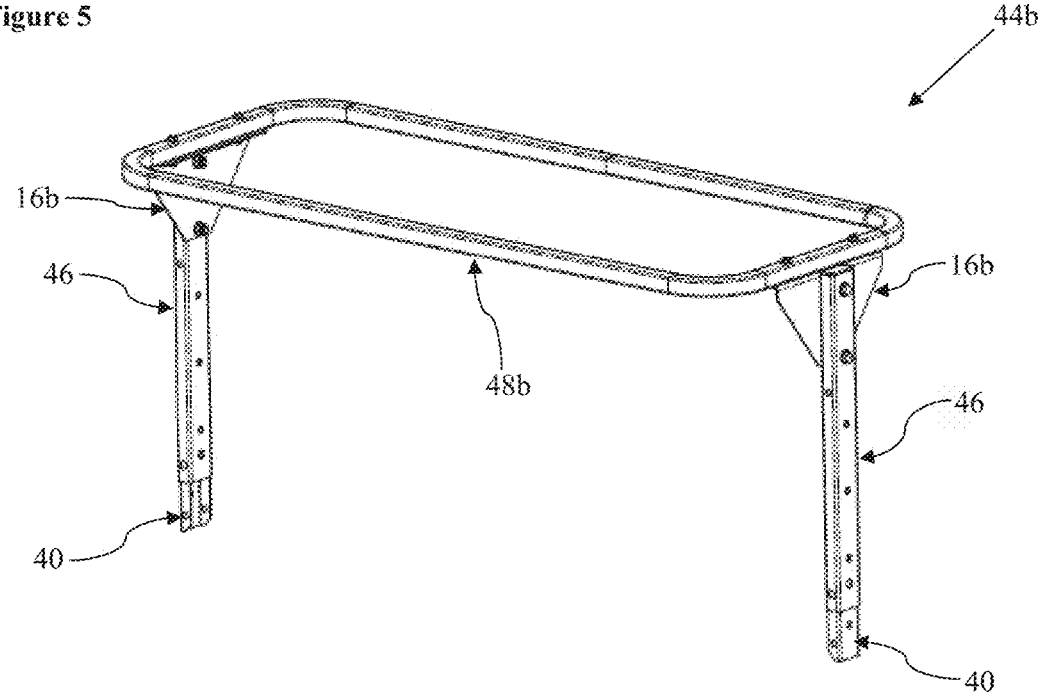
FIG. 5 shows an isometric view of a second embodiment of a bridging unit for the reconfigurable fitness equipment storage apparatus shown in FIG. 1, the bridging unit being suitable for use in the freestanding condition shown in FIG. 2.

FIG. 5 shows a second optional bridging unit 44*b* which may be engaged with the reconfigurable fitness equipment storage apparatus 10 to provide further storage for fitness equipment in the freestanding condition.

The shelving element 14 of the second bridging unit 44*b* is formed as a support bar 48*b* which is O-shaped or formed as a complete loop, thereby forming a corresponding bounded region to that of the C- or U-shaped support bar 48*a* of the first bridging unit 44*a* without needing the presence of the wall. This support bar 48*b* is supportable by a balanced pair of brackets 16*b* such that a centre of gravity of the support bar 48*b* is coincident or substantially coincident with the plane extending between the uprights 12 in the freestanding condition.

It is noted that the majority of the construction of the cantilevered support bar 48*a* is identical to that of the balanced support bar 48*b*. As such, the balanced support bar 48*b* may be formed by engaging complementarily formed first and second support bar members which respectively project in opposite directions from the uprights 12 in the freestanding condition. The first and second support bar members could be telescopically extendible relative to one another to permit adjustment of the depth of the shelving element 14 in use, for example, to accommodate different sizes of medicine ball. This could also be applied to the standard planar shelving elements 14; the shelving element of the wall-mounted condition could be formed from two opposed shelving members in the freestanding condition which are interengaged or both engaged with their respective brackets or uprights.

Figure 6:
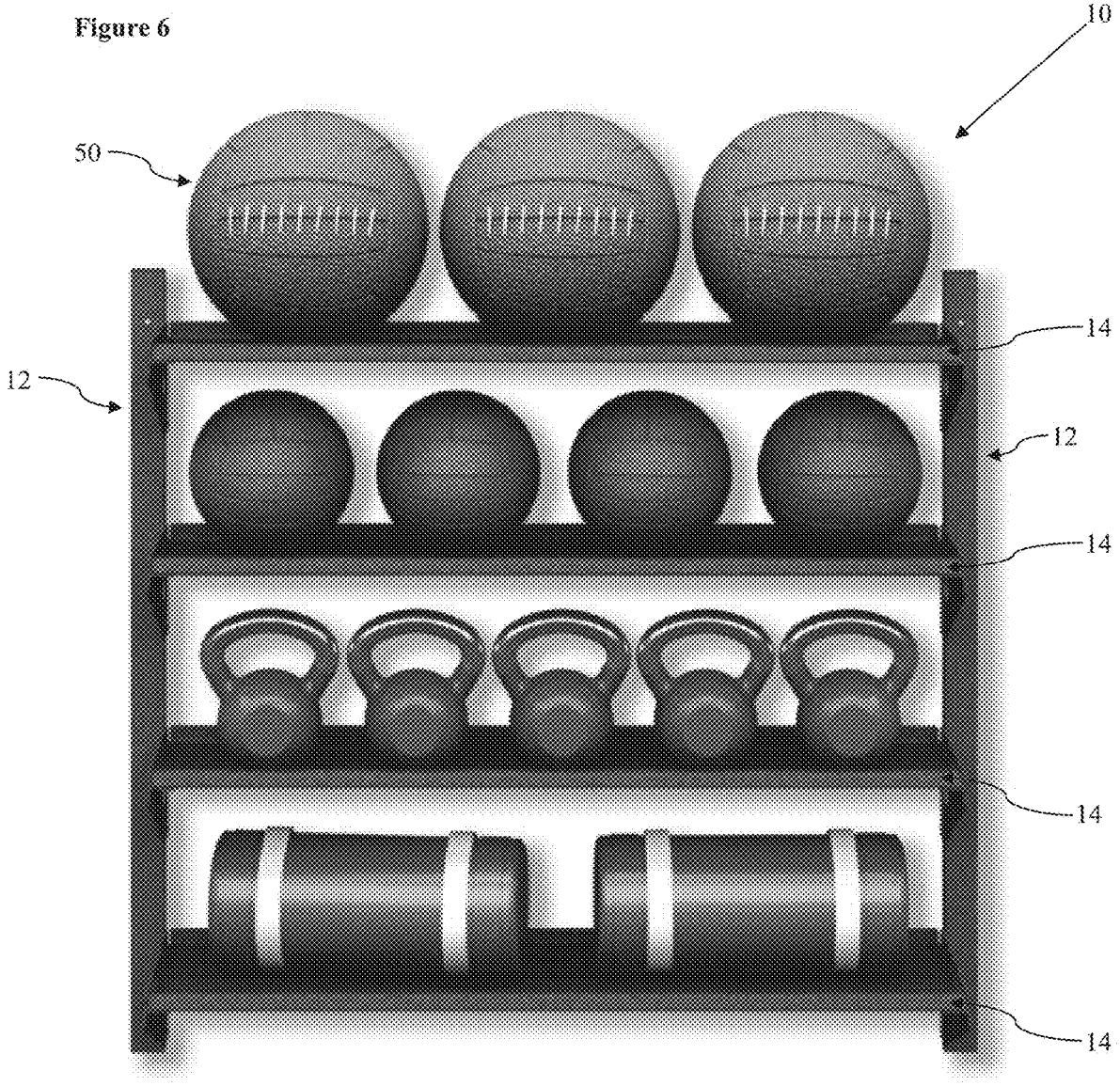
FIG. 6 shows a front representation of the reconfigurable fitness equipment storage apparatus of FIG. 1 in a first wall-mounted condition including a selection of fitness equipment.

FIG. 6 shows the wall-mounted condition of the reconfigurable fitness equipment storage apparatus 10 in use, with several different types of fitness equipment 50 stored thereon.

Figure 7A:
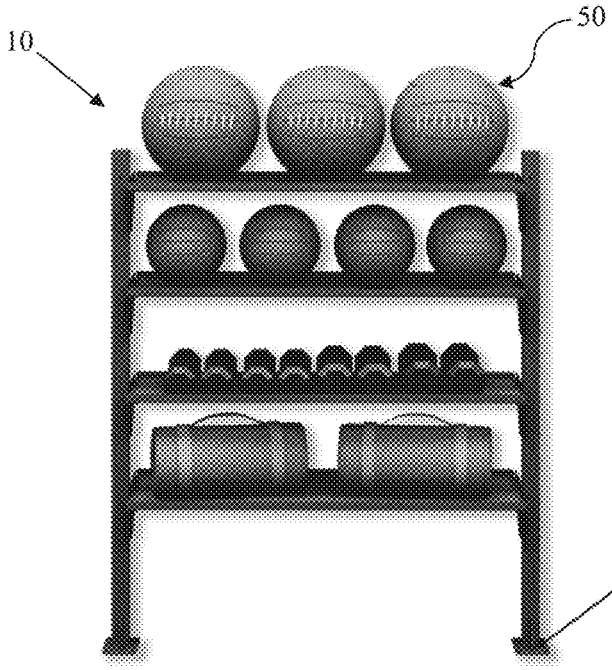
FIG. 7*a* shows a front representation of the reconfigurable fitness equipment storage apparatus of FIG. 6 in a first freestanding condition.
Figure 7B:
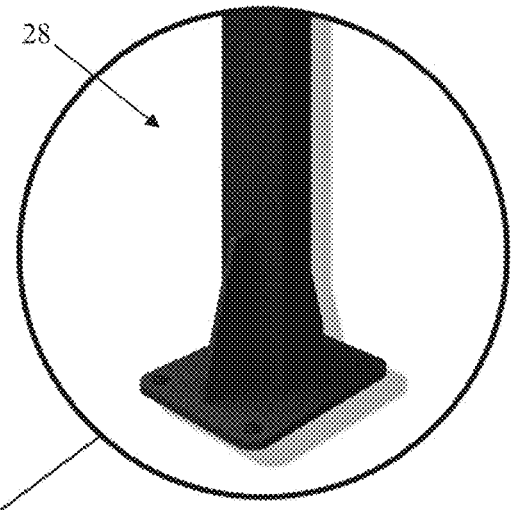
FIG. 7*b* shows an enlarged perspective representation of one ground support member of the reconfigurable fitness equipment storage apparatus of FIG. 7*a;*

FIG. 7*a* shows an equivalent image of the reconfigurable fitness equipment storage apparatus 10 in use, with FIG. 7*b* showing an enlarged image of the foot portion 30 of the ground support member 28. In this arrangement, the reconfigurable fitness equipment storage apparatus 10 is likely to be relatively unstable as the ground plates 32 are shallow relative to the shelving elements 14, and therefore fixing to the floor is advisable.

Figure 8A:
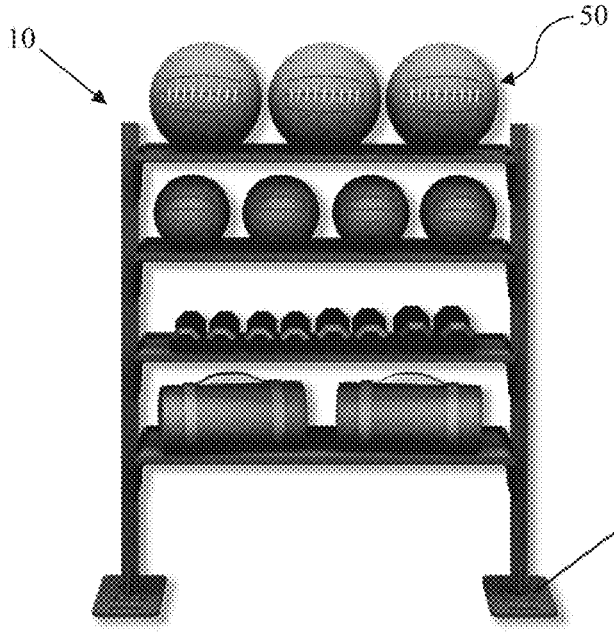
FIG. 8*a* shows a front representation of the reconfigurable fitness equipment storage apparatus of FIG. 6 in a second freestanding condition.
Figure 8B:
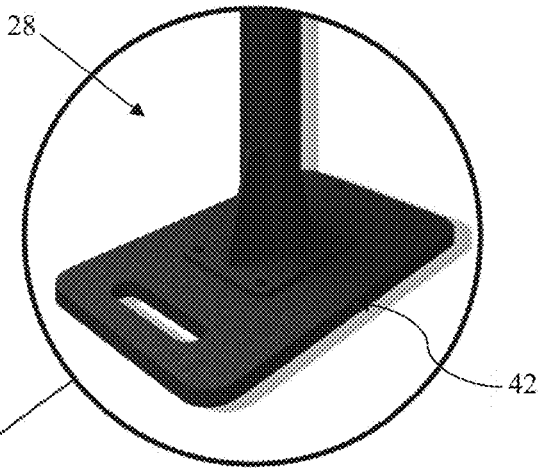
FIG. 8*b* shows an enlarged perspective representation of one ground support member of the reconfigurable fitness equipment storage apparatus of FIG. 8*a;*

FIG. 8*a* shows a second arrangement of the reconfigurable fitness equipment storage apparatus 10 inclusive of the stabilisation plates 42, shown in detail in FIG. 8*b*. The stabilisation plates 42 are much deeper than the ground plates 32 in comparison to the shelving elements 14, and therefore such an arrangement may be feasible without securing the reconfigurable fitness equipment storage apparatus 10 to the floor. This may allow the reconfigurable fitness equipment storage apparatus 10 to be repositioned at will.

FIG. 9*a* shows the reconfigurable fitness equipment storage apparatus 10 in the wall mounted condition, inclusive of the first bridging unit 44*a* as shown in FIG. 5. Exemplary medicine balls 52 are illustrated, and can be seen in detail in FIG. 9*b*. The receiving of the medicine balls through the support bar 48*a* can be seen in more detail.

FIG. 9*b* shows the reconfigurable fitness equipment storage apparatus 10 in the freestanding condition, inclusive of the second bridging unit 44*b* as shown in FIG. 6. Again, exemplary medicine balls 52 are illustrated showing their positioning on the support bar 48*b*.

Whilst the invention has been hereto described utilises elongate unitary uprights 12, it will be appreciated that, in the context of a modular reconfigurable fitness equipment storage apparatus 10, it may be more prudent to form the uprights 12 from a plurality of upright portions which are interengagable, for example, via an interference fit which are held together under gravity, or may be locked or engaged together using, for example, screw-threaded fasteners. Each upright 12 may therefore be formed from a plurality of upright portions to selectively alter a length of each upright. Modularisation of the uprights may beneficially allow a user to selectively form the apparatus at a height of their choosing. This may well be important for buildings with unusually high or low ceilings.

It is therefore possible to provide a modular apparatus for fitness equipment storage which can be readily reconfigured between a wall-mountable condition and a freestanding condition. By careful manipulation of the positions of the shelving elements of the apparatus, it is possible to safely support heavy fitness equipment which might otherwise require bespoke shelving or storage apparatuses.

The words 'comprises/comprising' and the words 'having/including' when used herein with reference to the present invention are used to specify the presence of stated features, integers, steps or components, but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of examples only, and various other modifications will be apparent to persons skilled in the field without departing from the scope of the invention as defined herein.

That which is claimed is:

1. A reconfigurable fitness equipment storage apparatus which is both freestanding and wall-mountable, the reconfigurable fitness equipment storage apparatus comprising:

two spaced apart parallel elongate uprights, each having a plurality of connection apertures;

a wall-engagable element to retain each upright in a position relative to an associated wall;

a ground support member associated with each upright;

at least one shelving element which is selectably mountable between the uprights in a wall-mounted condition and a freestanding condition;

a first pair of brackets being provided for mounting the or each shelving element to the uprights in the wall-mounted condition, the first pair of brackets being connectable to a plurality of connection apertures and being cantilevered from the uprights in use; and a different second pair of brackets being provided for mounting the or each shelving element to the uprights in the freestanding condition, the second pair of brackets being connectable to the same connection apertures as the first pair of brackets, wherein the brackets of the first pair are differently shaped to the brackets of the second pair and each bracket of the second pair of brackets has a centre of gravity which is coincident or substantially coincident with the plane extending between the uprights;

in the wall-mounted condition, the or each shelving element being cantilevered from the uprights to be fixable to the wall via the wall-engagable elements; and in the freestanding condition, the or each shelving element being positioned such that a centre of gravity of the or each shelving element is coincident or substantially coincident with a plane extending between the uprights to enable the storage apparatus to be self-supported on the said ground support members.

2. The reconfigurable fitness equipment storage apparatus as claimed in claim 1, further comprising a releasable connector which releasably secures a relative position of the or each shelving element to the at least one pair of brackets.

3. The reconfigurable fitness equipment storage apparatus as claimed in claim 1, wherein the or each shelving element comprises a single shelving member which is selectively engagable with the at least one pair of brackets in the wall-mounted and freestanding conditions.

4. The reconfigurable fitness equipment storage apparatus as claimed in claim 1, wherein the or each shelving element comprises a first shelving member which is cantilevered from the uprights in a first direction in the wall-mounted condition, and a second shelving member which at least in part projects away from the uprights in a second direction which is opposite to the first said direction in the freestanding condition, wherein the first and second shelving members are mutually engagable in the freestanding condition.

5. The reconfigurable fitness equipment storage apparatus as claimed in claim 1, wherein the ground support members are releasably engagable with their respective uprights.

6. The reconfigurable fitness equipment storage apparatus as claimed in claim 1, further comprising a telescopic member which is engagable with the uprights and ground support members to permit telescopic adjustment of a vertical position of the support apparatus.

7. The reconfigurable fitness equipment storage apparatus as claimed in claim 1, further comprising a bridging unit which is engagable with both uprights at or adjacent to the top of the uprights.

8. The reconfigurable fitness equipment storage apparatus as claimed in claim 7, wherein the bridging unit is releasably engagable with the tops of the uprights.

9. The reconfigurable fitness equipment storage apparatus as claimed in claim 7, wherein the said bridging unit is or includes a said shelving element.

10. The reconfigurable fitness equipment storage apparatus as claimed in claim 9, wherein first and second said bridging units are provided, the first bridging unit including a shelving element which is cantilevered from the uprights to be fixable to the wall via the wall-engagable elements in the wall-mounted condition, and a second bridging unit including a shelving element which is positioned such that a centre of gravity of the said shelving element is coincident or substantially coincident with the plane extending between the uprights in the freestanding condition.

11. The reconfigurable fitness equipment storage apparatus as claimed in claim 7, further comprising a telescopic member which is engagable with the uprights and bridging unit to permit telescopic adjustment of a vertical position of top of the support apparatus.

12. The reconfigurable fitness equipment storage apparatus as claimed in claim 1, wherein a plurality of shelving elements is provided, at least one shelving element being provided as a medicine-ball-supporting shelf having only a support bar, the support bar defining an opening within which a medicine ball is receivable.

13. The reconfigurable fitness equipment storage apparatus as claimed in claim 1, wherein a plurality of shelving elements is provided, at least one shelving element comprising a planar shelf which extends between the uprights, the planar shelf including a reinforcing member and/or receiving element for a reinforcing member.

14. The reconfigurable fitness equipment storage apparatus as claimed in claim 1, wherein each ground support element comprises a foot portion and a stabilisation plate which is engagable with the foot portion.

15. The reconfigurable fitness equipment storage apparatus as claimed in claim 1, wherein each upright is formed from a plurality of upright portions to selectively alter a length of each upright.

16. The reconfigurable fitness equipment storage apparatus as claimed in claim 1, in the form of a kit of parts.

17. The reconfigurable fitness equipment storage apparatus as claimed in claim 1, wherein the or each shelving element is rectangular.

18. The reconfigurable fitness equipment storage apparatus as claimed in claim 1, wherein the or a said shelving element comprises a support bar, devoid of a planar shelf.

19. A method of converting a wall-mounted fitness equipment storage apparatus to a freestanding fitness equipment storage apparatus, the method comprising the steps of:

a] providing a reconfigurable fitness equipment storage apparatus as claimed in claim 1 in a wall-mounted condition;

b] disengaging the wall-engagable elements from a wall to which the uprights are mounted;

c] converting the or each shelving element from its cantilevered state of the wall-mounted condition to its balanced state of the freestanding condition such that a centre of gravity of the or each shelving element is coincident with a plane extending between the uprights; and d] standing the reconfigurable fitness equipment storage apparatus on its ground support members so as to be freestanding.

20. A method of converting a freestanding fitness equipment storage apparatus to a wall-mounted fitness equipment storage apparatus, the method comprising the steps of:

a] providing a reconfigurable fitness equipment storage apparatus as claimed in claim 1 in a freestanding condition;

b] converting the or each shelving element from its balanced state of the freestanding condition such that a centre of gravity of the or each shelving element is coincident with a plane extending between the uprights to its cantilevered state of the wall-mounted condition; and c] engaging the wall-engagable elements with a wall to mount the uprights thereto.

* * * * *